United States Patent [19]

Baker et al.

[11] Patent Number: 4,611,640

[45] Date of Patent: Sep. 16, 1986

[54] COIL SPRING ASSEMBLY APPARATUS

[75] Inventors: Garland A. Baker, Spring Lake; Ronald S. Powers, Fennville, both of Mich.

[73] Assignee: Holland Wire Products, Inc., Holland, Mich.

[21] Appl. No.: 706,314

[22] Filed: Feb. 27, 1985

[51] Int. Cl.[4] ..... B21F 21/00

[52] U.S. Cl. ..... 140/92.3; 140/92.7

[58] Field of Search ..... 140/92.3, 92.5, 92.7, 140/92.93, 92.94

[56] References Cited

U.S. PATENT DOCUMENTS

| | | | |
|---|---|---|---|
| 1,930,715 | 10/1933 | Heuer | 140/92.7 |
| 2,275,209 | 3/1942 | Turgeon | 140/92.93 |
| 2,995,157 | 8/1961 | Catini | 140/92.7 |
| 3,090,407 | 5/1963 | Greeno et al. | 140/92.7 |
| 3,334,664 | 8/1967 | Wojahn | 140/92.7 |
| 3,648,737 | 3/1972 | Dull | 140/92.7 |

*Primary Examiner*—Francis S. Husar
*Assistant Examiner*—Robert Showalter
*Attorney, Agent, or Firm*—Price, Heneveld, Huizenga & Cooper

[57] ABSTRACT

A coil spring assembling machine with a row of clamp fittings for clamping coil springs in a row, and first sets of upper and lower coil drive planetary rollers at the infeed end of the row of clamps for infeeding upper and lower helical coils to connect the row of coil springs, at least one of the upper and lower clamps being replaced by a novel combination coil spring clamp and helical coil feeding unit with coil drive planetary rollers within the clamp jaws, for feeding the helical coils, the clamping jaws and feed rollers being simultaneously separable to allow release of the wire coils with release of the springs; a set of clinching units on the rear end of the row of clamps and a set of cutting and clinching units at the infeed end of the row of clamps, these units each having a rotational spindle with laterally offset, axially extending finger projections and an abutment surface for cooperatively clinching the ends of the helical wires, and the cutting and clinching units also having fixed cutoff blades adjacent the rotating spindles to nip off the ends of the helical wires being twisted.

13 Claims, 31 Drawing Figures

COIL SPRING ASSEMBLY APPARATUS

BACKGROUND OF THE INVENTION

This invention relates to machines for assembling coil springs by connecting them with elongated helical wire coils, as for mattresses, and more particularly to an improvement on the machine disclosed in U.S. Pat. No. 3,334,664 to Wojahn.

Assembly machines of the type in the Wojahn patent operate effectively, but have certain disadvantages. One is that there are significant waste helical coil portions cut off the tail end of each of the two helical coils for each row of springs assembled. That is, each helical coil must be made several inches longer than the rows of springs so that the trailing end will remain in the conventional upper and lower feed-in rolls, in order to drive the leading ends of the helical coils to the far end of the rows of springs. These several inch long portions must then be cut from each helical coil as waste. Another disadvantage of existing machines relates to the clinching and cutting for the ends of the helical coil. In some machines, the operators must twist the helical coils by hand to clinch the ends. While machines as in U.S. Pat. No. 3,648,737 provide mechanical clinching using a rotational clincher, and cutting with a reciprocating knife, an improved mechanism is needed.

SUMMARY OF THE INVENTION

The present assembling machine minimizes waste of helical coil, not requiring trailing end portions of helical coils to remain in the infeed rollers upstream of the clinching and cutting units. Yet, the helical coils are fully advanced to the far end of the rows of springs. Special combination spring-clamping and coil-feeding fitting units are located directly within the upper and lower rows of spring clamps, in place of certain conventional upper and lower fitting clamps, to not only clamp the springs but also receive and advance partially therethrough the upper and lower helical coils for connecting the rows of springs. Planetary coil drive rollers are located within clamp jaws in these special units, with the rollers and jaws being simultaneously separable to open and release the helical coils and the coil springs. When closed, these units have primary and secondary closure biasing means.

Novel clinching units at both ends of the wire coils are unique, having rotational spindles with laterally offset, axially extending finger projections for dependably clinching the coil wires. The upstream clinching units at the infeed end have fixed cutoff blades positioned alongside thereof to nip the tail ends of the wires being twisted.

The novel spring clamping and coil feeding units and the novel clinching units can be employed independently on an assembly machine, or can both be employed in combination on the assembly machine.

The resulting apparatus is rapid and dependable, requiring little manual labor, and minimizing scrap from the trailing ends of the wire coils.

These and other features, aspects and advantages of the inventive features will be readily apparent to those in the art from the following detailed written description in conjunction with the drawings.

DESCRIPTION OF THE PREFERRED EMBODIMENT

This present invention is an improvement of the machine depicted and described in the U.S. Pat. No. 3,334,664, to Wojahn, issued Aug. 8, 1967, the disclosure of which is incorporated by reference herein. The purpose of such a coiling machine is to interconnect coil springs by winding helical wires onto the upper and lower ends of adjacent coil springs while the latter are held in position by clamp-type fittings. At each end of the mattress, these coils connect the individual coil springs in a single row, while in the other portions of the mattress each new row of coil springs is connected to the preceding row as well as to each other. That is, the individual clamped springs in the row are secured to each other and to the adjacent row of springs by helically winding the helical wire coil along the upper and lower ends of the springs, as is well known. These clamp fittings are spaced at predetermined intervals from each other, to cause the coil springs loaded into the clamps to be at this same spacing interval. Because the coil springs are normally positioned in a vertical orientation during assembly, and the wire coils are fed in horizontally, from one end of the row of springs, e.g. the left end as viewed in FIG. 1, along the top of the row and along the bottom of the row respectively toward the rear end of the rows, i.e. the right end as viewed in FIG. 1, these particular orientations will be employed herein to describe the invention. However, it should be realized that it is the relative arrangement between the components which is significant, not whether they are vertical, horizontal, or the like. The structural arrangement of the framework and power drive components of this assembling machine are described in detail in the Wojahn patent. And the present invention involves adding certain apparatus to that machine, and employing combination spring clamping and wire coil advancing fittings in that machine in place of certain conventional clamp fittings, as described hereinafter. Because the description of the machine of that patent is incorporated by reference herein, it would be superfluous to repeat the details of such herein. Thus, this description is directed primarily to the improvements, and the relationship thereof to the standard components in the combination.

Figure 1:
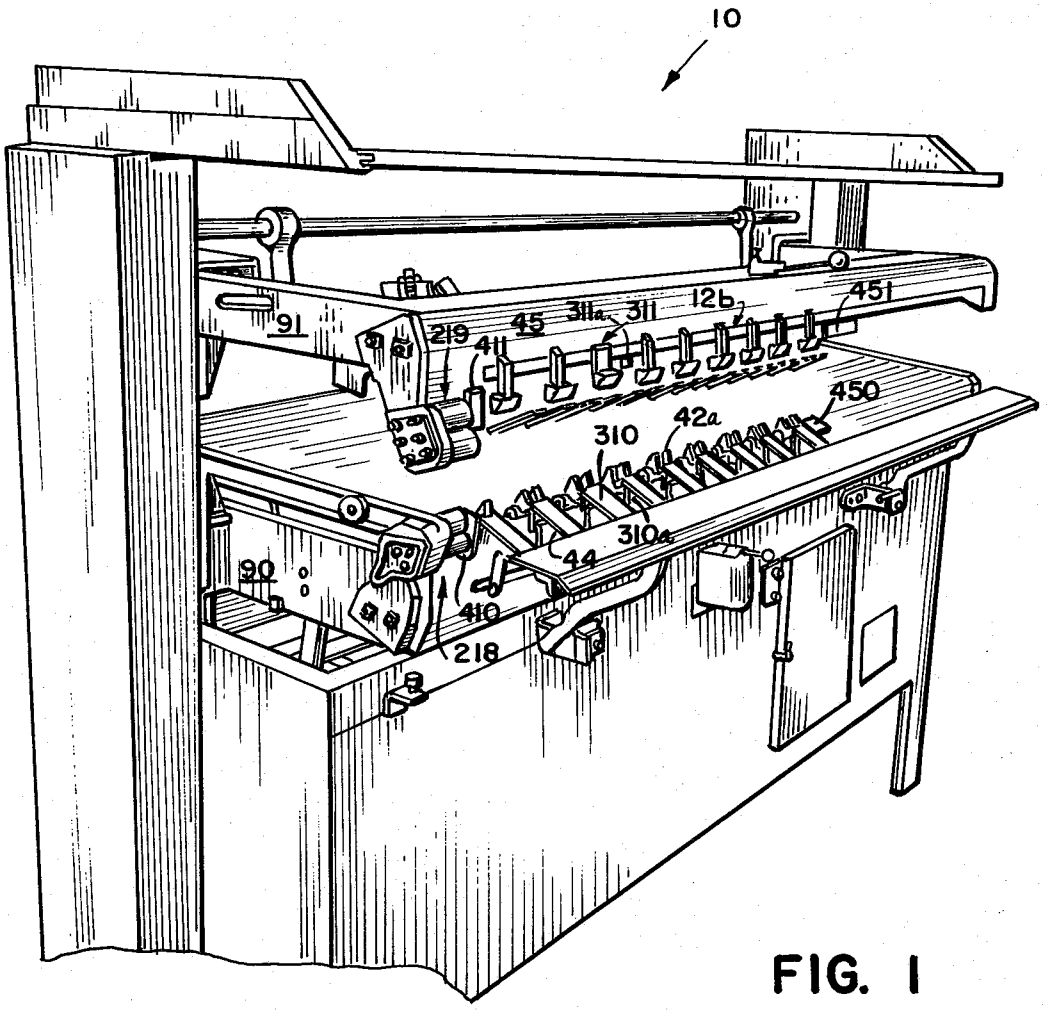
FIG. 1 is a perspective view of a coil spring assembling machine employing this invention.
Figure 25:
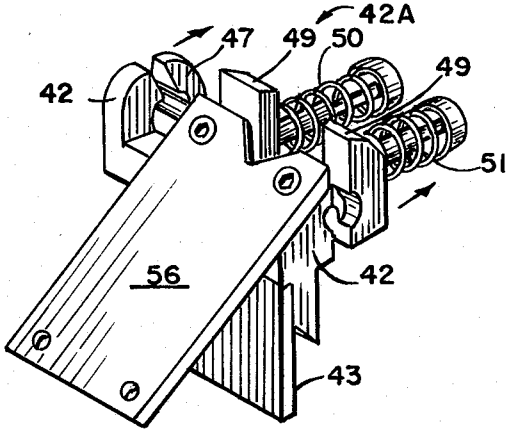
FIG. 25 is a perspective view of the spring clamping fitting in FIG. 24, shown open.

Referring to FIG. 1, a row of upper clamps and a row of like-positioned lower clamps are arranged to clamp and retain the top and bottom of a row of coil springs. These are individually inserted into the clamps from the front of the machine. They are then interconnected by transversely advanced wire coils helically threaded onto the respective upper and lower ends of the coil springs in the manner described in the Wojahn patent. The conventional individual clamps are shown in the Wojahn patent FIGS. 8 and 23–26 and also herein in FIGS. 1, 24 and 25. The clamps are secured to mounting plates to be laterally adjustable thereon to accommodate the particular size and spacing of coil springs desired. The plates are on beams which are vertically shiftable toward and away from each other to move into a coil locking condition or a coil releasing condition.

The jaws of the individual clamps 42A and 42B are biased toward a closed-jaw, spring-clamping condition as explained in the Wojahn patent at column 3, and with respect to Wojahn FIGS. 8–9 and 23–26, but are movable against the bias of its springs 49 and 50 (FIG. 25) to open for release of the coil springs. Thus, with vertical separation of the beams, the coil springs can be advanced out of the clamps along with the helical wires.

Figure 7:
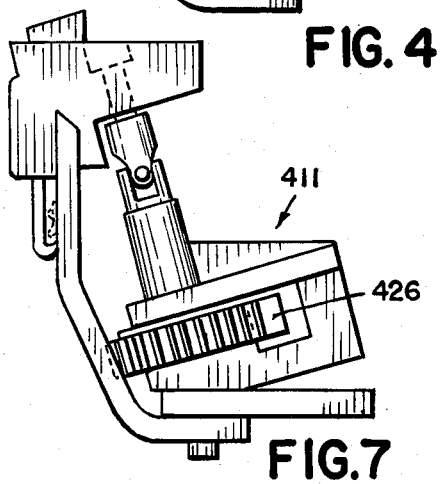
FIG. 7 is an end elevational view of the apparatus in FIG. 5.

Upstream (i.e. to the left) of the lower and upper rows of clamps are sets of lower and upper coil drive planetary rollers 218 and 219 (FIG. 1), described in detail in the Wojahn patent relative to FIG. 7.

When operating the prior Wojahn patent apparatus, the wire coils for interconnecting the row of coil springs, at the top and bottom thereof, are horizontally fed by these coil drive planetary rollers until the wire coils wind around and interconnect the tops and bottoms of the coil springs to the far end of the rows. At that point, a significant portion of each wire coil still necessarily extends upstream of the clamps into the drive rollers in order to drive the coil to the far end. This several inch long portion of each wire coil then had to be cut off as waste.

The present invention involves replacement of at least one of the conventional spring clamps in the upper row and at least one of the conventional spring clamps in the lower row, by a novel combination spring clamping and helical coil feeding unit or fitting, having a set of planetary coil drive rollers nestled within the clamping jaws. A clamped coil spring surrounds the rollers, with the wire coil being fed directly through the jaws by powering the rollers while the rollers squeeze the wire coil. The combination unit is equipped with a jaw closure biasing spring. It also has roller biasing means in the form of a fluid cylinder, usually an air cylinder, for applying gripping bias of the planetary arranged rollers on the helical wire to be fed. Preferably, this cylinder is actuated in response to sensing means which senses the advance of the helical coil being fed toward this combination unit by the exterior roller sets 218 and 219.

Figure 14:
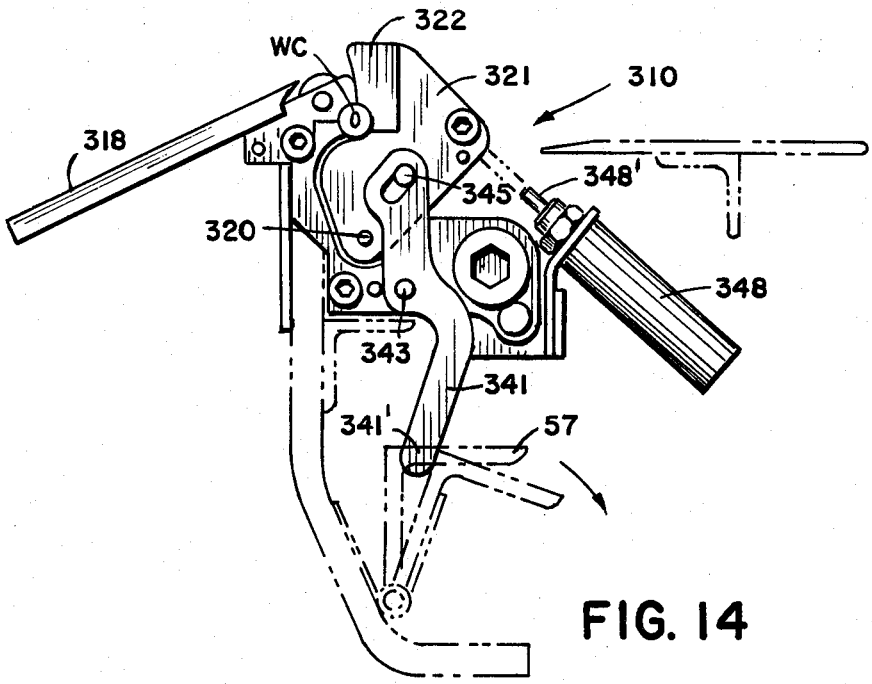
FIG. 14 is an end elevational view of the lower, combination spring clamping and helical coil feeding fitting at the (left) infeed end of the lower row of clamps.

The combination units cause the planetary rollers to open simultaneously with opening of the straddling spring clamping jaws thereof, so that the row of coil springs interconnected to each other and to the preceding row by the helical coils are released simultaneously with release of the helical coils thereon, the coil springs having been retained by the jaws and the coils having been retained by the planetary rollers. Specifically, the same bar actuator 57 that opens the jaws of the conventional clamps against the biasing springs thereof (Wojahn, column 3 and FIGS. 8 and 9) also opens the jaws and planetary rollers of the novel combination units (FIG. 14).

Figure 15:
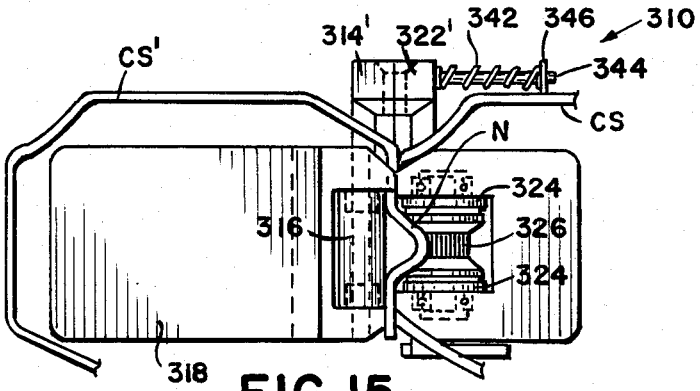
FIG. 15 is a top plan view of the fitting unit in FIG. 14.
Figure 17:
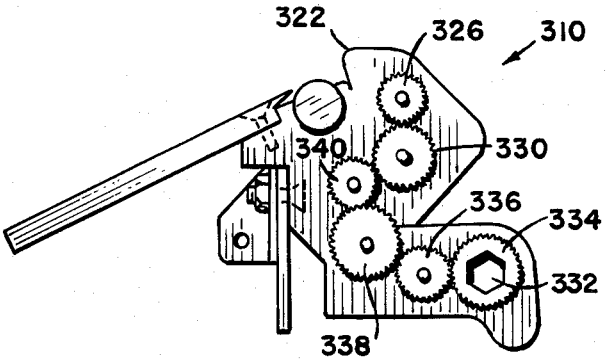
FIG. 17 is a sectional view taken on plane XVII—XVII through the center of the unit in FIG. 16.
Figure 16:
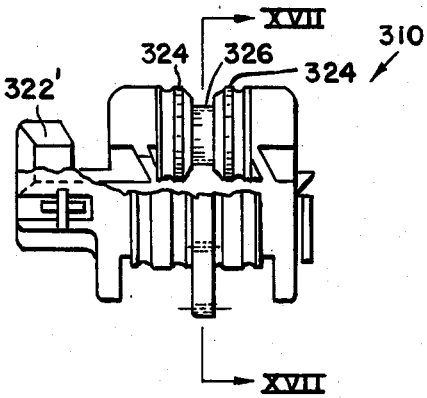
FIG. 16 is a side elevational view of the central components in the fitting unit.

In this invention, at least one combination spring clamping and helical coil feeding unit 310 is mounted on beam 44 in place of at least one of the conventional spring clamps 42A. Likewise, an upper combined unit 311 is mounted on beam 45 in place of at least one of the upper spring clamps 42B. Lower unit 310 is depicted in detail in FIGS. 14–17 and 22–23. It includes a mounting plate 312 having fixed jaws 314 thereon, and an axially extended half-funnel cooperative with a mirror image half-funnel 322' to form a guide for the helical coil advancing toward the rollers of this fitting. Between jaws 314 is a rotatable, helically grooved idler roller 316 straddled by the jaws. A slanted ramp plate 318 is aligned with jaws 314 and roller 316 for assistance in guiding the lower end of a vertical coil spring pushed into the unit, usually manually. Pivotally mounted on axis 320 is a jaw support 321 including jaws 322 spaced from each other and pivotal with jaw support 321 toward and away from fixed jaws 314. It also has an extended half-funnel 322' noted above. Between jaws 322 is a segmented, helically grooved, powered roller, formed of helically grooved end portions 324, and a central recessed spur gear portion 326. The annular inside faces of portions 324 are at an angle, e.g. about 45° (see FIG. 16) to receive and align the conventional nose N (FIG. 15) on coil spring $CS^1$. Beneath this roller is a third roller 328 (FIG. 23) having a spur gear 340 (FIG. 17) driving gear 326 through an intermediate idler gear 330. These two gears 326 and 340 are power driven. Specifically, a hexagonal power shaft 332 (FIG. 17) fits in a hexagonal socket 332' (FIG. 22) to drive spur gear 334 (FIG. 17) which drives spur gear 336, which drives spur gear 338, which drives spur gear 340 engaging gear 330 as shown.

Figure 23:
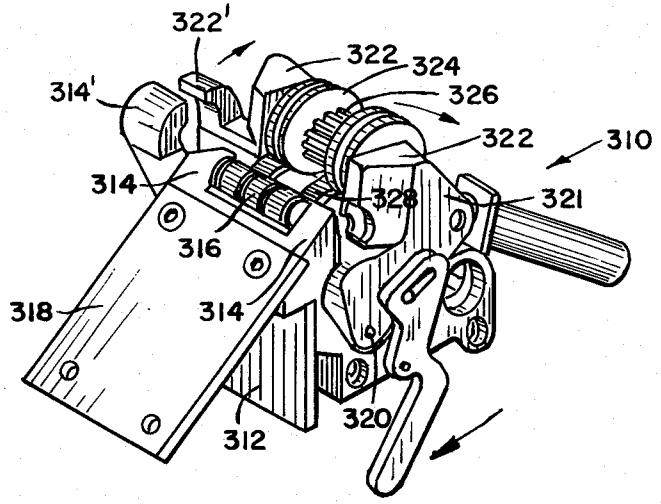
FIG. 23 is a perspective view of the apparatus in FIG. 22 in the open position.
Figure 22:
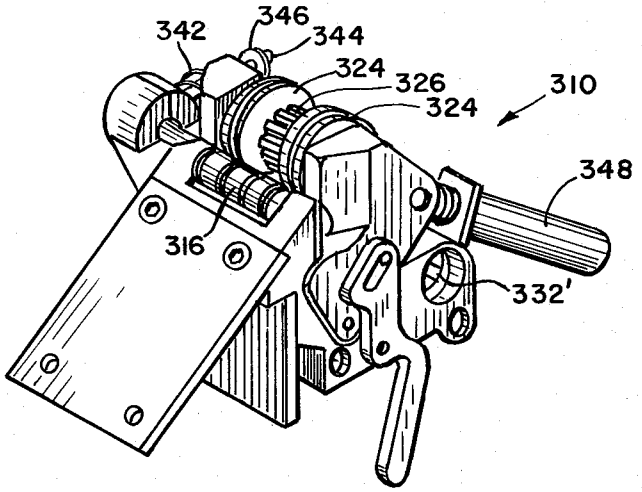
FIG. 22 is a perspective view of the lower combination fitting unit in FIG. 14, with the spring clamping jaws and the coil feeding rollers in closed position.
Figure 24:
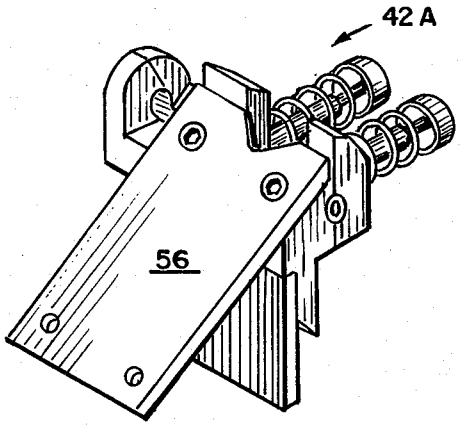
FIG. 24 is a perspective view of a conventional spring clamping fitting employed in this apparatus, and shown closed.

Movement of the pivotal jaws and powered rollers away from the fixed jaw and idler roller, i.e. from the closed position depicted in FIG. 22 to the open position depicted in FIG. 23, allows simultaneous escape of the clamped coil springs and the helical coil interconnected therewith. The jaws and rollers are normally biased toward a closed position by coil spring 342 (FIG. 15) positioned around plate 344 and compressed between a retaining washer 346 and extended movable half-funnel 322'. Plate 344 has its inner end connected to fixed half-funnel 314'.

Figure 27:
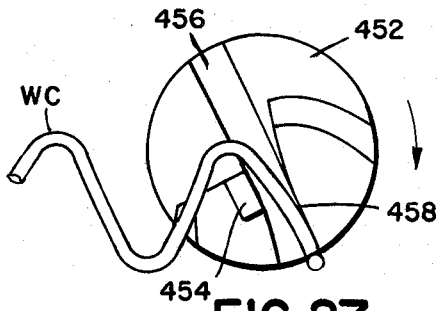
FIGS. 27 through 30 are successive views, greatly enlarged, of the rotational spindle forming part of each of the upper and lower coil clinching units on the right (rear) end of the apparatus in FIG. 1, with FIG. 27 showing the coil therein in the initial position ready to be clinched, FIG. 28 showing the spindle rotated a small amount, FIG. 29 with the spindle rotated a further amount, and FIG. 30 showing the final orientation of the clinching spindle prior to reverse rotation thereof.

In order to apply effective squeezing force by the three planetary arranged rollers against a surrounded helical coil, for frictionally advancing the helical coil transversely through the rollers and clamping jaws by driving the grooved rollers, an additional biasing means in the form of a fluid (air) cylinder 348 is attached to the fixed clamp unit. Its piston rod 348' is extendable (FIG. 14) to abut the pivotal jaw and roller subassembly 321 and apply effective squeezing force on the helical coil WC (FIG. 14). The powered rollers 324 and 328 thus frictionally advance the helical coil through their helical grooves in cooperation with helically grooved idler roller 316. This advancing helical coil thus winds around and interconnects the adjacent coil springs CS (FIG. 15) as depicted in FIG. 27 of the Wojahn patent. When piston rod 348' of cylinder 348 is retracted, pivotal jaw support 321 can be opened by crank arm 341. It is pivotally mounted intermediate its ends on pin 343, is pivotally connected with a pin and slot arrangement 345 on one end thereof to the jaw support 321, and has its free end 341' engageable by shiftable torsion bar 57 (FIG. 14). This torsion bar also simultaneously opens the conventional clamps 42A in the manner explained in the Wojahn patent, when pivoted by its fluid actuator (66 in Wojahn) or the equivalent. Thus, the combination unit 310 is opened simultaneously with opening of the conventional clamps 42A.

The upper combination unit 311 (FIGS. 1 and 18–21) is directly comparable to the lower unit described in detail above, being basically in mirror image thereto. Therefore, its like components are depicted but will not be described in detail. As noted previously, the cutting and clinching units 410 and 411, as well as the clinching units 450 and 451, can be used without clamp and drive units 310 and 311. Each functions effectively.

The apparatus is depicted and explained, however, with all of these components on the assembly machine, in combination. Located downstream of units 310 and 311, in alignment with the infeeding wire coils, is sensing means such as an electrical contact switch **310*a* and 311*a* respectively (FIG. 1) to be engaged by the leading ends of the helical coils after they are advanced through units 310 and 311. These sensors in turn are operably electrically connected with controls such as conventional solenoid operated pneumatic control valves (not shown) which are in turn operably pneumatically connected with the biasing cylinders 348 and 349. They actuate the pneumatic valves which in turn allow extension of the air cylinder piston rods to apply the additional biasing force to the pivotal jaw supports for forcing the driven and idler rollers of units 310 and 311 together around the helical coils to effectively advance the helical coils. Because these units 310 and 311 advance the helical coils to the far (right) end of the rows of springs, the coils need not be of extra length to cause a tail-end portion to remain in the roller feeders 218 and 219 (FIG. 1). Rather, the tail end is advanced out of feeders 218 and 219** to preferably leave only a small end portion to be nipped off the tail end of the helical coil.

The coil cutter and clincher units will be described in detail hereinafter relative to unit 410 on the lower infeed (left) side of the machine as depicted, i.e. downstream of the infeed roller assembly 218. Unit 411 thereabove is a mirror image version thereof and therefore will not be described in detail. The purpose of these units is to clinch the tail end of the helical coils while simultaneously nipping off the portion of coil which may remain. This achieves exact control of the length of the helical coil, secures the assembly, and prevents the end from later snagging. The specific apparatus for achieving this is described following a description of the clinching units 450 and 451 at the far (right) end of the machine.

Figure 2:
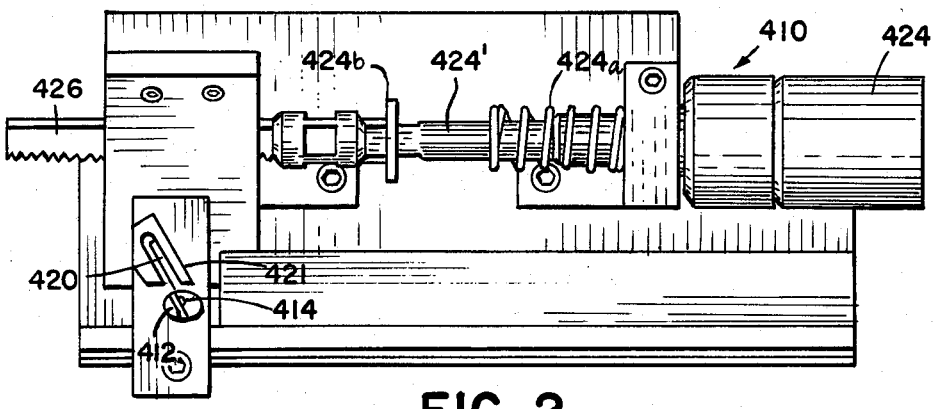
FIG. 2 is an enlarged plan view of the portion of the machine in FIG. 1 containing the lower coil-cutter and clincher unit at the (left) infeed end of the machine.
Figure 9:
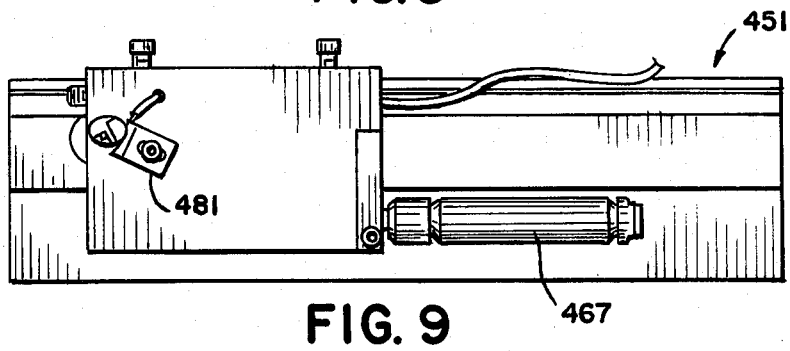
FIG. 9 is a bottom view of the apparatus in FIG. 8.
Figure 11:
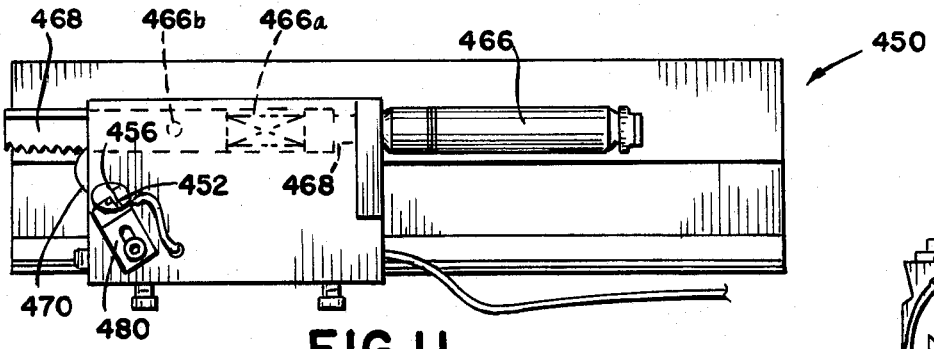
FIG. 11 is a top plan view of the lower coil clincher unit on the lower (right) rear end of the apparatus in FIG. 1.
Figure 12:
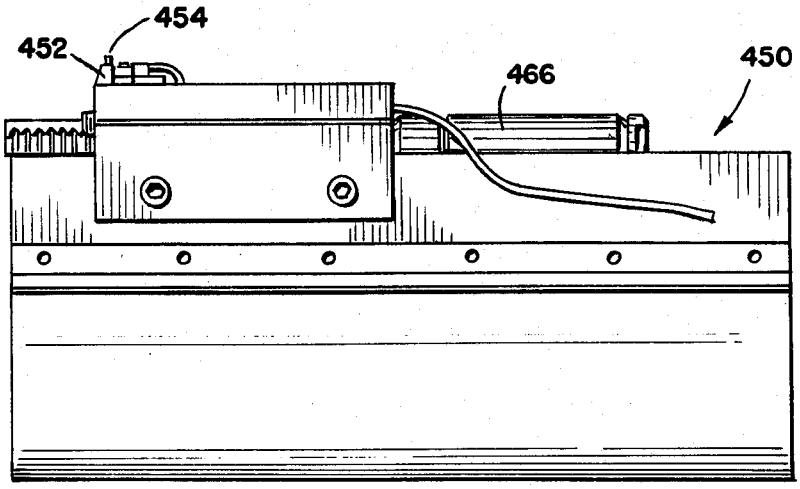
FIG. 12 is a front elevational view of the apparatus in FIG. 11.
Figure 13:
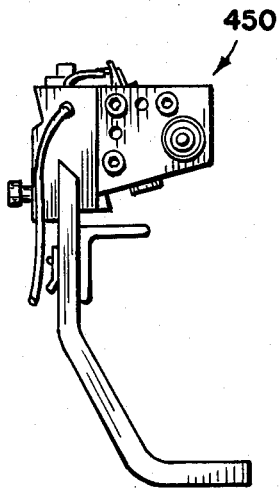
FIG. 13 is an end elevational view of the apparatus in FIG. 12.

In FIGS. 11, 12 and 13 is the lower clincher unit located at the far (right) end of the assembly in FIG. 1. This unit 450 has a clinching arrangement like that in cutting and clinching unit 410 (FIG. 2), but without the cutting blade and blade holder in that subassembly. In other words, the leading end of the helical coil which has wrapped around the row or rows of coil springs enters this clinching unit. The particular location of this clinching unit along the mounting plate can be adjusted to accommodate whatever length of helical coil is necessary. Located at the clinching units 450 and 451 are stops and limit switches 480 and 481 (FIGS. 11 and 9).

Figure 3:
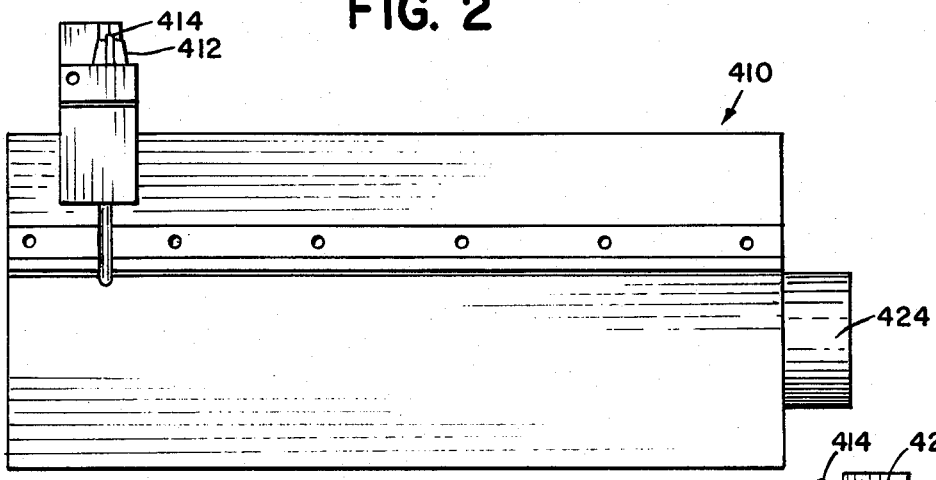
FIG. 3 is a front elevational view of the apparatus in FIG. 2.
Figure 30:
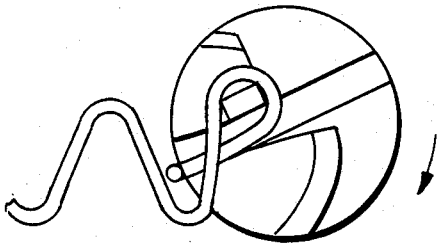
Figure 28:
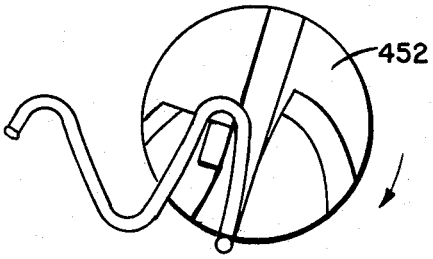
Figure 31:
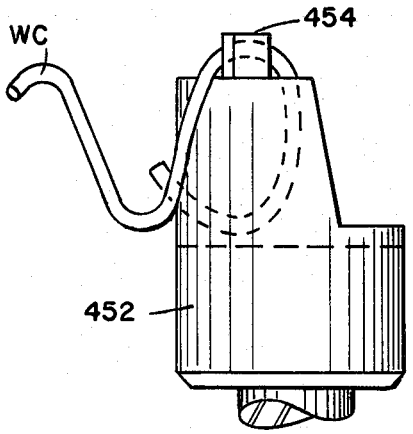
FIG. 31 is an elevational view of the spindle and coil in FIG. 30.
Figure 29:
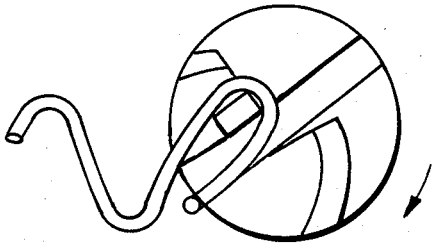
Figure 26:
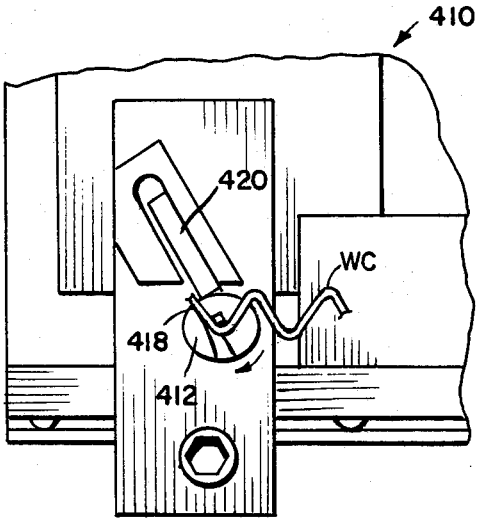
FIG. 26 is a fragmentary enlarged top plan view of the lower (left) coil cutting and clinching unit, with a helical coil in place to be operated upon for clinching and cutting.

Clincher unit 450 includes an axially rotational vertical spindle 452 which has a laterally offset (i.e. from the spindle axis), axially extending integral finger projection 454 protruding therefrom i.e., projecting axially beyond the remainder of the spindle (FIG. 31). This finger projection moves in an eccentric, i.e. annular path (detailed in FIGS. 27–30) during rotation of the spindle. Adjacent to finger 454 is an open ended cross slot 456 in the spindle, and abutment surface 458 (FIG. 27) alongside the slot, extending axially and laterally. The cooperative effect of the rotating finger projection, slot and abutment surface serve to twist the helical coil end into a clinched i.e., looped condition around the finger projection (FIGS. 30 and 31). The spindle 452 is power rotated in one direction through the clinching action, and then is reversed to its starting position. These movements are caused by an air cylinder 466, the piston rod of which is attached to a gear rack 468. Engaging this gear rack is a spur gear 470 that rotates spindle 452. (The details of this drive are like that for unit 410 in FIGS. 2–4). During rotation of the spindle, with the end of the wire coil extending into slot 456, the bitter wire end is twisted. Projection 454 acts to stabilize the loop portion of the helical coil on the opposite side of the coil from the free end, i.e. 180° out, giving twisting leverage for abutment wall 458 to bend and clinch the free or bitter end of the wire. After the wire is twisted through this sequence, depicted in FIGS. 27–30, the tension is released on the spindle by springs as explained hereinafter, and the spindle is withdrawn with spreading of the beams of the machine during release of the assembled helical coils and coil springs.

Figure 8:
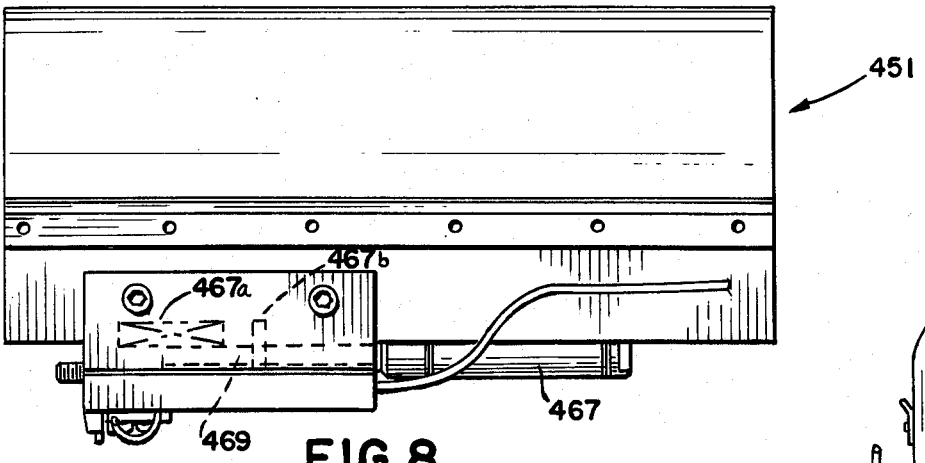
FIG. 8 is a front elevational view of the coil clincher unit at the upper (right) rear end of the machine in FIG. 1.
Figure 10:
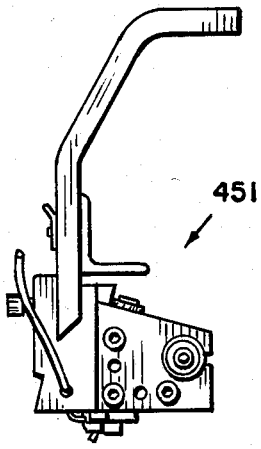
FIG. 10 is an end elevational view of the apparatus in FIG. 8, taken from the right end.

Stop and limit switch 480 is activated by the entering far end of the wire coil. This contact switch controls the actuation of air cylinder 466 on unit 450, and a comparable air cylinder 467 on unit 451 (FIGS. 8–10). This is preferably done by the contact switch actuating a time delay relay to conventional solenoid operated pneumatic control valves (not shown) in turn operably connected to the noted air cylinders. It also simultaneously activates air cylinders 424 and 425 on the clinching and cutting units 410 and 411 (FIGS. 2–7). The two clinching units 450 and 451 thus twist the leading ends of the lower and upper helical coils while the cutting and clinching units 410 and 411 clinch and cut off a small tail portion of the helical coils at the infeed end of the machine in a manner to be described. The control air valve then releases these four cylinders. Preferably the tension is released on the twisting spindles by springs which reverse the gear racks a small amount upon release of the air cylinders so that, as the bars of the assembly machine are opened by raising and lowering them respectively, the clinched, i.e. locked helical wire coils are released from the clamping fittings. The machine table is then ready to be indexed one step to advance the last row of springs one position, allowing the operator to load a new series of individual coil springs into the fittings for attachment of the next upper and lower wire coils.

The cutting and clinching units will be described particularly with respect to the upper unit 410, it being realized that the lower unit 411 is a like arrangement in mirror image. Specifically, unit 410 includes a spindle 412 rotatable on its slightly tilted vertical axis, and having an axially extending, laterally offset (i.e. from the spindle axis) integral finger projection 414. Again, this finger projection moves in an eccentric, i.e. annular path during rotation of the spindle. Adjacent finger 414 is an open ended cross slot 416 in the spindle, and an abutment surface 418 (FIG. 26) alongside the slot, to cooperatively twist the helical coil end into a clinched orientation. Immediately adjacent the spindle is a fixed cutting blade 420 retained in its holder 421. The blade is generally radially oriented to the spindle periphery, to have its cutting edge immediately adjacent it, so that as the spindle is rotated and the wire is being twisted into its clinched condition, the blade will snip off any portion of the wire coil greater than the desired length, as surface 418 forces the wire past it. Here again, projection 414 stabilizes the loop portion of the wire coil on the opposite side of the coil from the free end, i.e. 180° out, giving twisting leverage for the abutment wall to clinch the free end of the wire and also force it against the fixed cutting blade.

Figure 4:
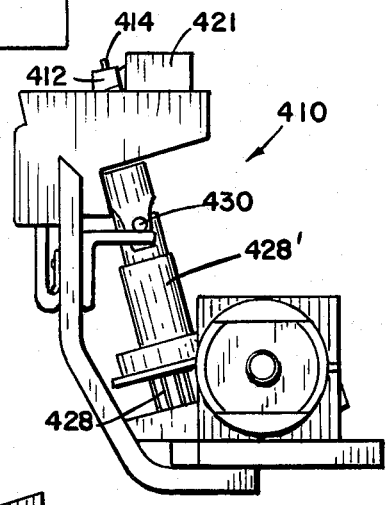
FIG. 4 is an end elevational view of the apparatus in FIG. 2, viewed from the right end of the apparatus as depicted.

Spindle 412 is power rotated in one direction through this clinching and cutting movement, then the tension is released for slight reversal of the spindle to allow coil removal, and then spindle 412 is completely reversed to its starting position. The forward rotation is caused by retraction of air cylinder 424 (FIG. 2) or the equivalent, having a gear rack 426 on the end of its piston rod 424'. This gear rack engages a spur gear 428 (FIG. 4) connected to spindle 412 through a shaft 428' and a universal joint 430 (FIG. 4). The cutting and clinching unit 411 (FIGS. 5, 6 and 7) is a like arrangement, in mirror image, to operate on the lower helical coil in the same fashion. The power drive for both of these cutting and clinching units and also the clinching units 450 and 451 is alike.

Figure 5:
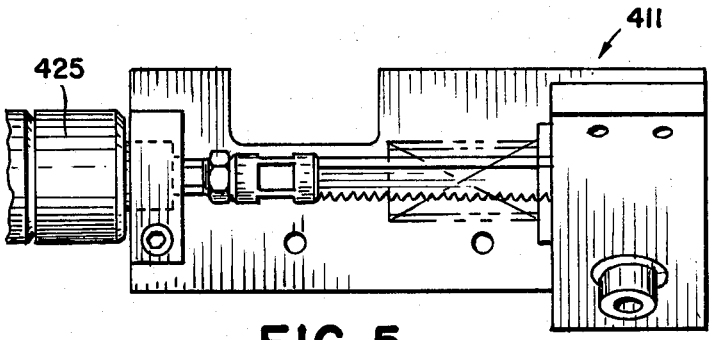
FIG. 5 is a bottom view of the upper coil cutter and clincher unit at the (left) infeed end of the machine, but with the clincher spindle and the cutter blade removed.
Figure 6:
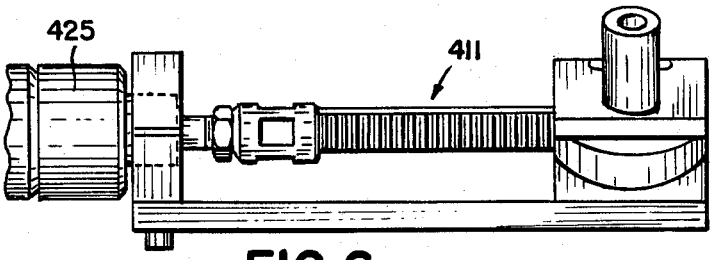
FIG. 6 is a front elevational view of the apparatus in FIG. 5.

The springs which release the tension are compression coil springs such as at **424*a* (FIG. 2) around gear rack 424' to extend the retracted gear rack a fraction of an inch after the pressure on air cylinder 424 is released. This spring was axially compressed by washer 424*b* when the gear rack was retracted by cylinder 424. Unit 411 has a like spring (FIG. 5**).

Units 450 and 451 have comparable spring arrangements including compression springs **466*a* and 467*a* respectively, (FIGS. 8 and 11), operable on racks 468 and 469 having pin-shaped abutments 466*b* and 467*b* for the springs to engage. Thus, upon release of pressure to cylinders 466 and 467**, these springs rotate the spindles a small amount in reverse to release the coils.

OPERATION

Although the operation of the assembly machine is believed to be clear from the above description, a brief review of such will here be set forth.

With the beams of the machine shifted toward each other to the desired spacing, and fitting clamps 42A and 42B positioned to form upper and lower rows of clamps, as well as at least one upper and one lower conventional clamp being replaced by the novel combination fittings 310 and 311, a worker inserts a plurality of individual coil springs into the fittings. For convenience, it is assumed that a previous row of coil springs has been interconnected by previously inserted helical coils, and that row has been advanced one position adjacent the fittings, so that the plurality of coil springs now inserted by the worker is at least the second row. The coil springs are slightly compressed when manually slid into the fittings by the slanted ramps leading thereto, e.g. ramp 56 (FIG. 25) or ramp 318 (FIG. 23). The open jaws of the conventional fitting (FIG. 25) and the open jaws and spread rollers of the combination fittings (FIG. 23) will have a portion of the wire spring from each of the two adjacent rows therein. These jaws and the rollers are to be closed on both types of fittings simultaneously by rotation of torsion beam 57. The combination fitting will then appear as in FIG. 15, with the inserted coil spring CS' having its nose N nestled into the generally Vshaped slot of roller 324, for alignment of the spring.

Figure 18:
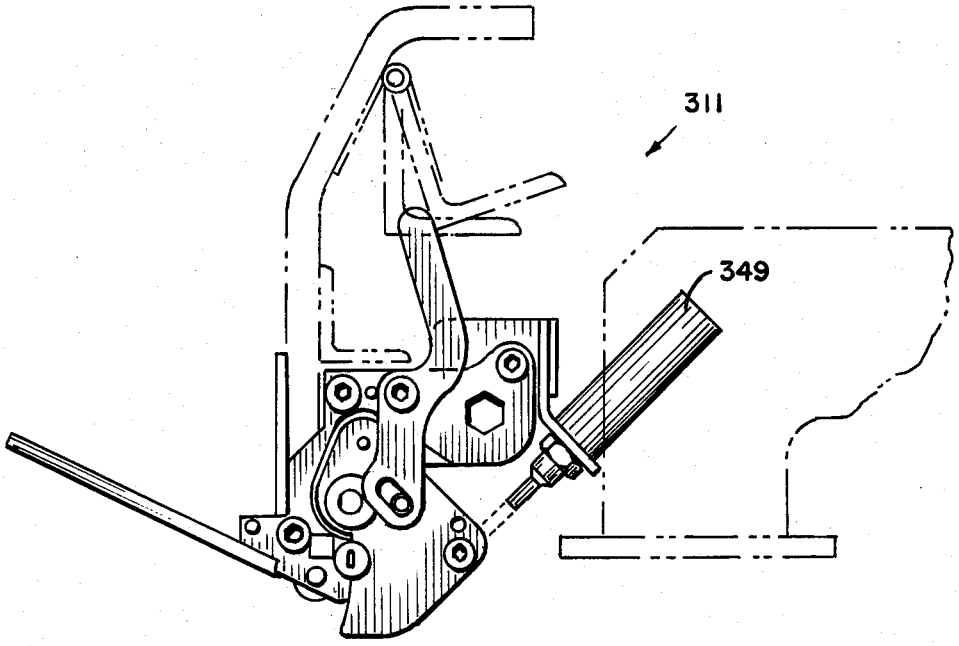
FIG. 18 is an end elevational view of the upper, combination spring clamping and helical coil feeding fitting unit at the (left) infeed end of the upper row of clamps.
Figure 19:
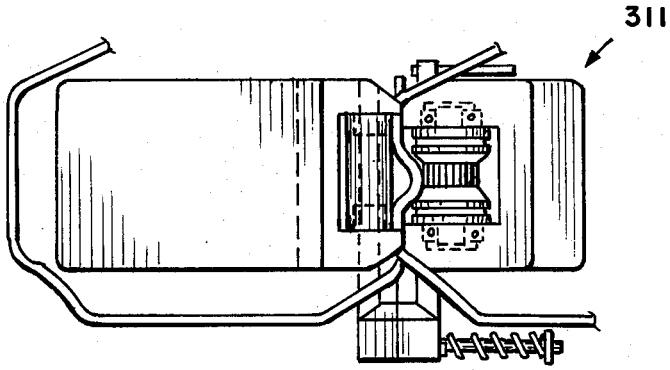
FIG. 19 is a bottom view of the fitting unit in FIG. 18.
Figure 21:
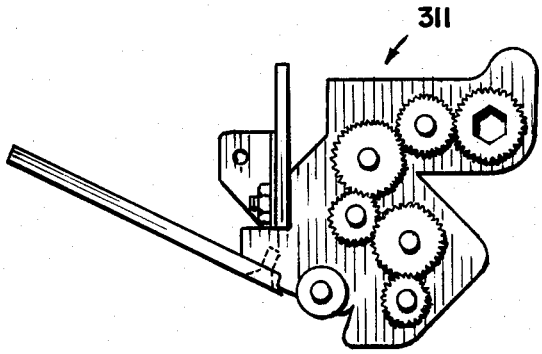
FIG. 21 is a sectional view taken on plane XXI—XXI through the center of FIG. 20.
Figure 20:
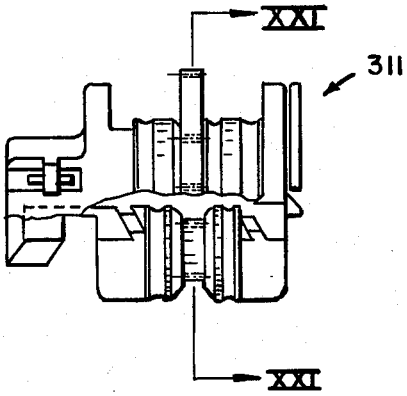
FIG. 20 is a side elevational view of the central components of the fitting in FIGS. 18 and 19.

Upper and lower helical coils are then laterally horizontally inserted into the exterior drive roller assemblies 218 and 219 (FIG. 1) on the left side of the machine. These powered rollers helically advance the wire coils into the fittings and along the rows thereof. After the helically moving axially advancing helical coils wrap around the coil springs in the first couple of fittings, each wire coil passes through the funnel-shaped guide formed by members 322' and 314', e.g. see FIGS. 15 and 23, and between the helically grooved rollers power driven through the hexagonal shaft and gear arrangement for example depicted in FIG. 17. The advancing wire coils activate electrical switches 310*a* and 311*a* (FIG. 1) which activate the air cylinders, e.g. 348 and 349 for the lower and upper combination spring clamping and coil feeding units 310 and 311 (FIGS. 22 and 18). These cylinders apply the additional biasing force to the combination units causing pressing of the two driving rollers 324 and 328 toward idler roller 316 for snug frictional engagement about the helical coil after the coil has entered. At this point, these combination units take over the driving of the helical coils to the completion of the cycle.

As the wire coils reach clincher units 450 and 452 at the far end of the machine, they strike the limit switches 480 (FIG. 11) and 481. At this time the drive rollers in combination units 310 and 311, are deactuated, and the four air cylinders to the four twisting spindles in units 410, 411, 450 and 451 are actuated. Thus, the leading end of the wire coils is clinched, and the tail end of the wire coils at the infeed end of the machine is clinched and snipped. Spindle tension is then released on the clinched loops, the air cylinders biasing the rollers of the combined units 310 and 311 are released, beam 57 compresses the biasing springs of the conventional clamp fittings and the combination clamp fitting to open the jaws of the conventional fittings and to open the jaws and also the drive rollers of the combination fittings, the beams of the assembly machine move vertically away from each other to release the coil springs and assembled or interconnected helical coils, and the machine is advanced one stage to move this row of coil springs one position for subsequent loading of the next set of individual coil springs by the worker. The cycle is then repeated.

The assembly machine could conceivably be constructed to employ the present invention in alternative embodiments to the illustrative embodiment set forth in detail. Thus, the invention is intended to be limited only by that defined in the claims and the reasonable equivalents thereto.

The embodiments of the invention in which an exclusive property or privilege is claimed are defined as follows:

1. A coil spring assembling machine comprising:

a row of upper fitting clamps and a row of lower fitting clamps, each row having an infeed end and a rear end, for clamping the upper and lower ends of a plurality of coil springs in a row;

upper and lower coil drive means at said infeed end, upstream of said rows of clamps, for helically feeding respective upper and lower helical coils toward and along said rows of clamps to connect the clamped coil springs at the respective tops and bottoms thereof;

at least one upper and one lower combination spring clamping and helical coil feeding unit in said row of clamps, each of said combination units having coil spring-clamping jaws and each having wire coil-advancing rollers to advance helical coils therethrough, said combination units being operable to separate said jaws and separate said rollers simultaneously for releasing both the clamped springs and the wire coils therefrom;

each of said combination units including a fixed member having a pair of spaced fixed jaws astraddle a grooved roller and a pivotal member having a pair of jaws astraddle a pair of grooved drive rollers, said rollers being arranged in planetary fashion to engage a helical coil.

2. The machine in claim 1 including closure biasing spring means at each of said clamps for biasing such shut, jaw closure biasing spring means at each of said combination units for biasing the jaws shut, supplemental biasing means on said combination units actuable for biasing said rollers together on a helical coil for drive friction by said rollers on the helical coil therein.

3. The machine in claim 2 wherein said supplemental biasing means comprises a fluid cylinder.

4. The machine in claim 1 including a crank arm on each said pivotal member, and a pair of actuators, one of said actuators arranged for actuating said crank arm on said upper combination unit and also actuating said fitting clamps in said upper row, and the other of said actuators arranged for actuating said crank arm on said lower combination unit and also actuating said fitting clamps in said lower row, for simultaneously opening said clamps, said combination unit jaws and said rollers after the helical coils are assembled to the coil springs.

5. The machine in claim 2 including:

sensing means located among said clamps between said coil drive means and said combination units for sensing advancing helical coils;

actuator means connected to said supplemental closure biasing means for actuating said supplemental closure biasing means; and said sensing means being operably associated with said actuator means for actuation of said supplemental closure biasing means upon sensing helical coils to cause said rollers to squeeze and advance the helical coils therein.

6. The machine in claim 3 including:

sensing means located among said clamps for sensing helical coil advanced through said combination units;

actuator valve means for actuating said fluid cylinder; and said sensing means being operably associated with said actuator valve means for actuation of said fluid cylinder to cause said rollers to squeeze and advance the helical coils therein.

7. A coil spring assembling machine comprising:

a row of upper clamps and a row of lower clamps, each having an infeed end and a rear end, for clamping a plurality of coil springs in a row;

upper and lower coil cutter and clinching units for cutting off and clinching the tail ends of the helical coils;

upper and lower coil drive means at said infeed ends, upstream of said coil cutter and clincher units, for helically feeding upper and lower helical coils toward and along said rows of clamps to connect the clamped coil springs at the tops and bottoms thereof;

upper and lower coil clinching units at said rear ends of said rows of clamps for clinching the leading ends of the helical coils; and said cutter and clinching units and also said clinching units each having a rotational twisting spindle with a laterally offset, axially extending finger projection projecting axially beyond the remainder of said spindle and rotatable with said spindle in an annular path for clinching the end of the helical wire into a loop during rotation of said spindle and said projection by causing the end of the helical wire to twist around said finger projection.

8. The machine in claim 7 wherein:

said cutter and clincher units each have a fixed blade, and each have said rotational spindle adjacent said fixed blade for advancing the coil wire past said fixed blade to cut excess wire at the end of the wire while clinching the end of the wire.

9. The machine in claim 7 wherein:

each of said spindles includes an open ended slot with an abutment surface adjacent said finger projection, whereby with rotation of said spindle said slot retains the end of the helical coil, said abutment surface bends the end of the helical coil, and said finger projection stabilizes the coil to allow leverage on the end of the coil for clinching.

10. The machine in claim 7 including fluid cylinder means connected to said rotational spindle for driving said rotational spindle to cause the clinching to occur.

11. The machine in claim 10 including tension release means for partially reversing said spindle after said fluid cylinder means has rotated said spindle, to release the wire coil therefrom.

12. The machine in claim 10 including engaged gear rack and gear means between said fluid cylinder means and said spindle for causing shifting of said fluid cylinder means to rotate said spindle.

13. The machine in claim 12 including compression spring-tension release means for partially reversing said spindle after said fluid cylinder means has rotated said spindle.

* * * * *